US012264827B2

(12) United States Patent
Kitabatake

(10) Patent No.: US 12,264,827 B2
(45) Date of Patent: Apr. 1, 2025

(54) OUTDOOR UNIT OF AIR-CONDITIONING APPARATUS

(71) Applicant: Mitsubishi Electric Corporation, Tokyo (JP)

(72) Inventor: Yo Kitabatake, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 228 days.

(21) Appl. No.: 17/784,692

(22) PCT Filed: Feb. 26, 2020

(86) PCT No.: PCT/JP2020/007610

§ 371 (c)(1),
(2) Date: Jun. 13, 2022

(87) PCT Pub. No.: WO2021/171399

PCT Pub. Date: Sep. 2, 2021

(65) Prior Publication Data

US 2023/0003398 A1 Jan. 5, 2023

(51) Int. Cl.
*F24F 1/56* (2011.01)
*F24F 1/16* (2011.01)

(52) U.S. Cl.
CPC . *F24F 1/56* (2013.01); *F24F 1/16* (2013.01)

(58) Field of Classification Search
CPC ..... F24F 1/56; F24F 1/16
See application file for complete search history.

(56) References Cited

U.S. PATENT DOCUMENTS

2014/0091692 A1* 4/2014 Miwa ..... F24F 13/20 312/285

FOREIGN PATENT DOCUMENTS

| | | | | |
|---|---|---|---|---|
| CN | 103712290 | A | 4/2014 | |
| CN | 203907820 | U | 10/2014 | |
| EP | 3742060 | A1 * | 11/2020 | ..... F24F 1/22 |
| JP | H05-069535 | U | 9/1993 | |
| JP | H09-145096 | A | 6/1997 | |
| JP | 2000-274738 | A | 10/2000 | |
| JP | 2005-180793 | A | 7/2005 | |
| JP | 2006-242544 | A | 9/2006 | |
| JP | 2010-060173 | A | 3/2010 | |
| JP | 2012-004214 | A | 1/2012 | |
| JP | 2012-042141 | A | 3/2012 | |

(Continued)

OTHER PUBLICATIONS

WO2013099904A1 mt (Year: 2013).*

(Continued)

*Primary Examiner* — Gordon A Jones
(74) *Attorney, Agent, or Firm* — Posz Law Group, PLC

(57) ABSTRACT

An outdoor unit of an air-conditioning apparatus includes: a housing configured to form an outer shell; and a heat exchanger provided to extend at a rear portion of the housing from a lower portion toward an upper portion of the housing, wherein the heat exchanger includes a heat exchanger side plate provided on a side portion and having a side plate locking hole at an upper portion, and the housing includes a rear panel being a plate-like part that forms a rear surface and including an upper rear-surface locking claw at an upper portion, the upper rear-surface locking claw being inserted into the side plate locking hole, and a top panel being a plate-like part provided on an upper side of the rear panel and forming a top surface of the housing, the top panel covering the side plate locking hole and the upper rear-surface locking claw.

1 Claim, 11 Drawing Sheets

(56) References Cited

FOREIGN PATENT DOCUMENTS

| | | | | | |
|---|---|---|---|---|---|
| JP | 2014-081139 | A | | 5/2014 | |
| JP | 2015017740 | A | * | 1/2015 | ..... F24F 1/56 |
| JP | 2018-071863 | A | | 5/2018 | |
| WO | 2013/099904 | A1 | | 7/2013 | |
| WO | 2019/130456 | A1 | | 7/2019 | |

OTHER PUBLICATIONS

JP2015017740A mt (Year: 2013).*
Office Action dated Sep. 6, 2023 issued in corresponding CN Patent Application No. 202080092937.X (and English machine translation).
Examination Report dated Oct. 11, 2023 issued in corresponding AU Patent Application No. 2020431597.
Examination Report dated Oct. 25, 2022 issued in corresponding IN Patent Application No. 202227046152.
Office Action dated Feb. 28, 2023 issued in corresponding DE Patent Application No. 112020006791.2 (and English translation).
Office Action dated Apr. 29, 2023 issued in corresponding CN Patent Application No. 202080092937.X (and English machine translation).
Office Action dated May 30, 2023 issued in corresponding JP Patent Application No. 2022-502640 (and English machine translation).
International Search Report of the International Searching Authority mailed Apr. 21, 2020 for the corresponding International application No. PCT/JP2020/007610 (and English translation).
Office Action dated Jan. 25, 2024 issued in corresponding CN Patent Application No. 202080092937.X (and English translation).

* cited by examiner

OUTDOOR UNIT OF AIR-CONDITIONING APPARATUS

CROSS REFERENCE TO RELATED APPLICATION

This application is a U.S. national stage application of PCT/JP2020/007610 filed on Feb. 26, 2020, the contents of which are incorporated herein by reference.

TECHNICAL FIELD

The present disclosure relates to an outdoor unit of an air-conditioning apparatus, the outdoor unit including a rear panel and a top panel.

BACKGROUND ART

Conventionally, there is a known outdoor unit of an air-conditioning apparatus, a housing of the outdoor unit being formed from a plurality of panels. In such an outdoor unit, a claw-like part provided on the panel is locked to an opening port formed in another panel or the like, to temporarily fix the panel. Patent Literature 1 discloses an outdoor unit where a locking claw of a side panel is locked to a locking hole of a rear panel.

CITATION LIST

Patent Literature

Patent Literature 1: Japanese Unexamined Patent Application Publication No. 2010-60173

SUMMARY OF INVENTION

Technical Problem

However, when the outdoor unit disclosed in Patent Literature 1 is exposed to rain water, moisture may adhere to the locking claw or the locking hole. In general, the housing of the outdoor unit is formed using steel sheets to which rust prevention treatment is applied to prevent the formation of rust. In such an outdoor unit, the locking hole, the locking claw, or the like may be obtained by cutting and molding a rust preventive steel sheet. In this case, rust prevention treatment is not applied to the cut surface of the locking hole, the locking claw, or the like. Accordingly, in Patent Literature 1, in the case where the locking hole, the locking claw, or the like is a part obtained by cutting and molding a rust preventive steel sheet, when the outdoor unit is exposed to rain water, there is a possibility that moisture flowing along the panel or the like adheres to the locking hole or the locking claw, thus allowing rust to form.

The present disclosure has been made to solve the above-mentioned problem, and it is an object of the present disclosure to provide an outdoor unit of an air-conditioning apparatus where it is possible to suppress the formation of rust on the locking hole or the locking claw.

Solution to Problem

An outdoor unit of an air-conditioning apparatus according to an embodiment of the present disclosure includes: a housing configured to form an outer shell; and a heat exchanger provided to extend at a rear portion of the housing from a lower portion toward an upper portion of the housing, wherein the heat exchanger includes a heat exchanger side plate provided on a side portion and having a side plate locking hole at an upper portion, and the housing includes a rear panel being a plate-like part that forms a rear surface and including an upper rear-surface locking claw at an upper portion, the upper rear-surface locking claw being inserted into the side plate locking hole, and a top panel being a plate-like part provided on an upper side of the rear panel and forming a top surface of the housing, the top panel covering the side plate locking hole and the upper rear-surface locking claw.

Advantageous Effects of Invention

According to the embodiment of the present disclosure, the top panel covers the side plate locking hole and the upper rear-surface locking claw. Therefore, even when the outdoor unit of the air-conditioning apparatus is exposed to rain water, the rain water impinges on the top panel and hence, moisture is prevented from easily adhering to the side plate locking hole or the upper rear-surface locking claw. Accordingly, in the outdoor unit of the air-conditioning apparatus, it is possible to suppress the formation of rust on the side plate locking hole and the upper rear-surface locking claw.

DESCRIPTION OF EMBODIMENT

Embodiment 1

Figure 1:
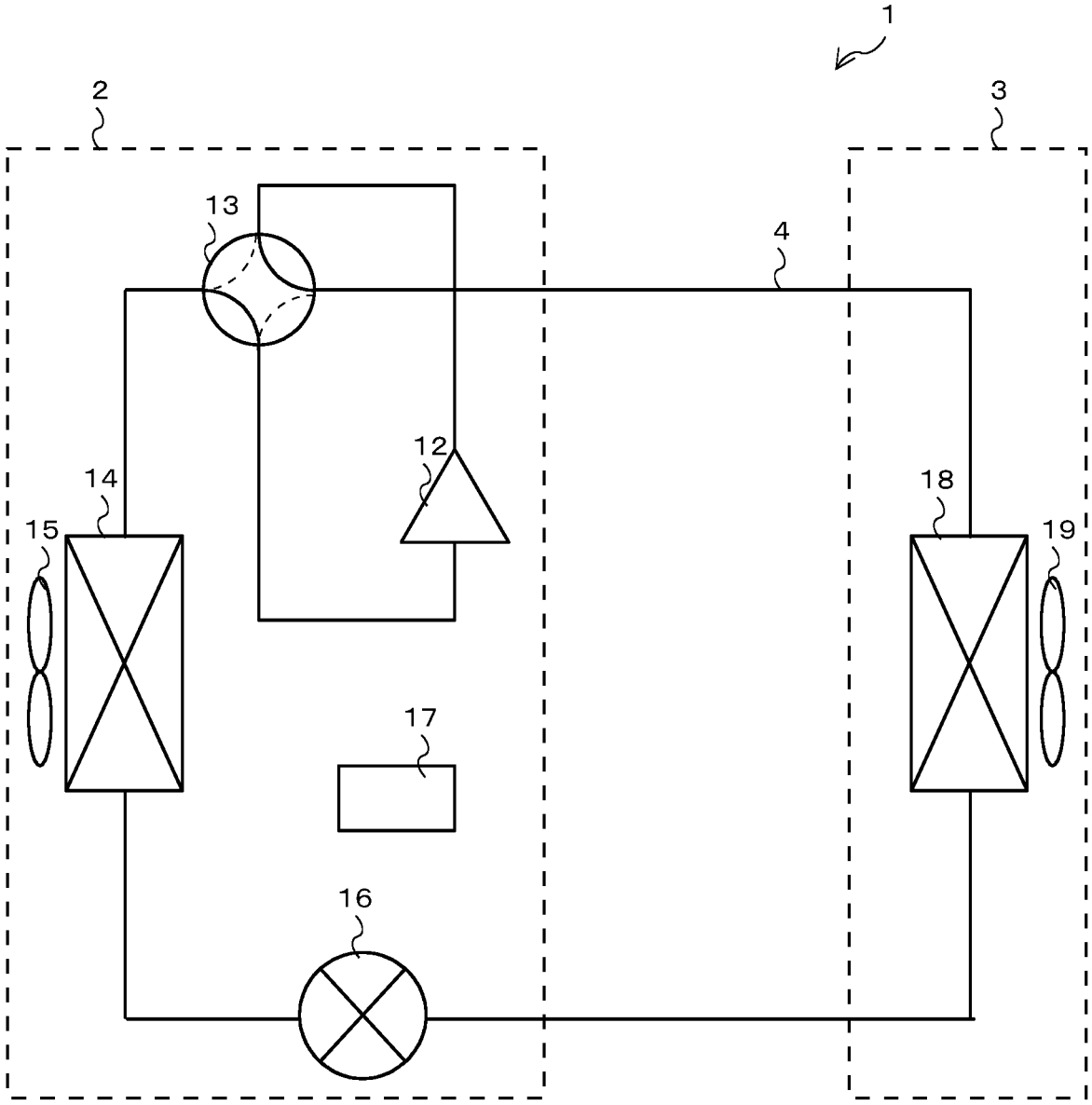
FIG. 1 is a circuit diagram showing an air-conditioning apparatus 1 according to Embodiment 1.

Hereinafter, an air-conditioning apparatus 1 according to Embodiment 1 will be described with reference to drawings. FIG. 1 is a circuit diagram showing the air-conditioning apparatus 1 according to Embodiment 1. As shown in FIG. 1, the air-conditioning apparatus 1 includes an outdoor unit 2, an indoor unit 3, and a refrigerant pipe 4.

(Outdoor Unit 2, Indoor Unit 3, Refrigerant Pipe 4)

Figure 2:
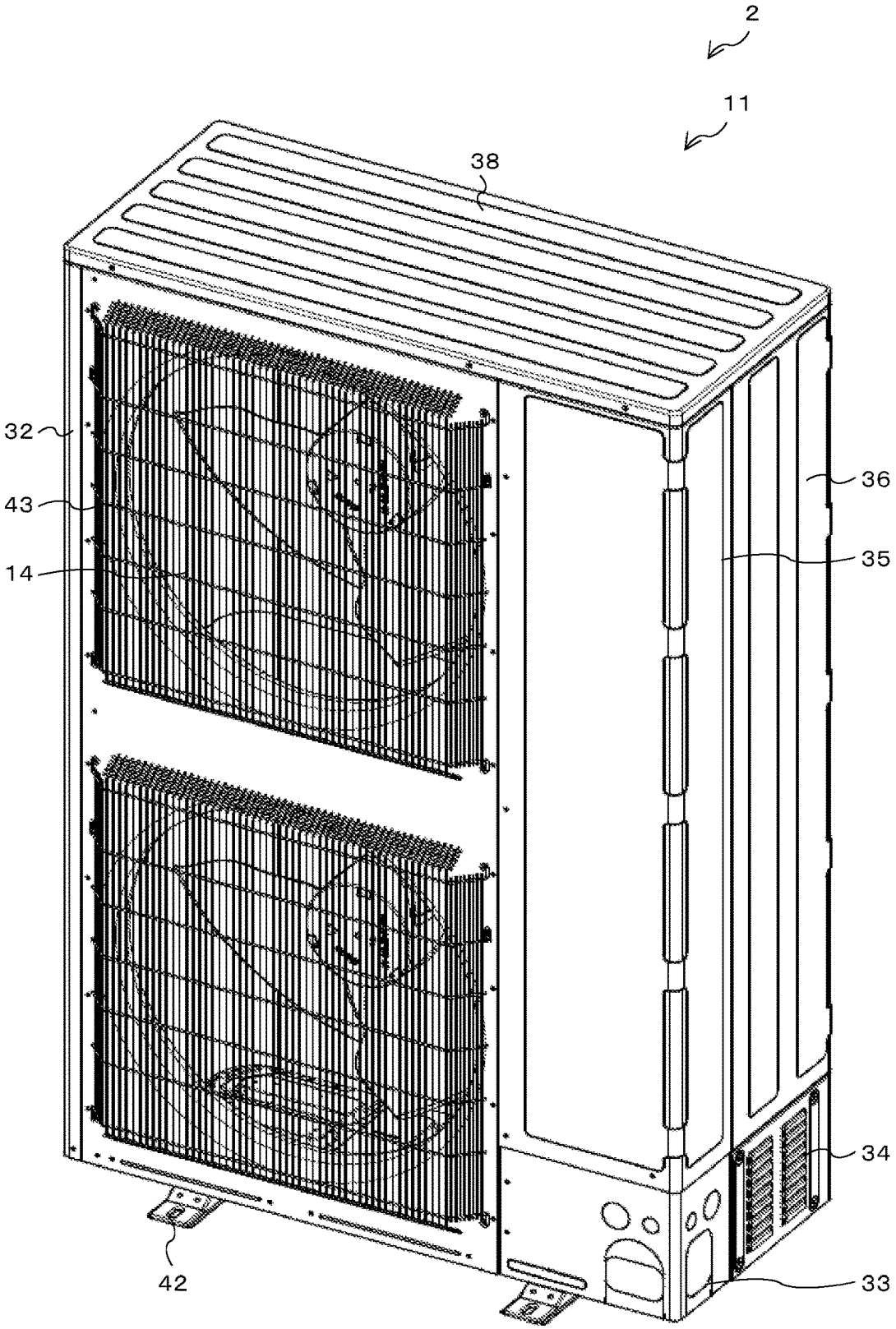
FIG. 2 is a front perspective view showing an outdoor unit 2 according to Embodiment 1.

The outdoor unit 2 includes a housing 11, a compressor 12, a flow passage switching device 13, an outdoor heat exchanger 14, outdoor fans 15, an expansion unit 16, and an electric component box 17 (see FIG. 2 for the housing 11). The indoor unit 3 includes an indoor heat exchanger 18 and an indoor fan 19. The refrigerant pipe 4 forms a refrigerant circuit by connecting the compressor 12, the flow passage switching device 13, the outdoor heat exchanger 14, the expansion unit 16, and the indoor heat exchanger 18 with each other and by allowing refrigerant to flow there through.

(Housing 11)

Figure 3:
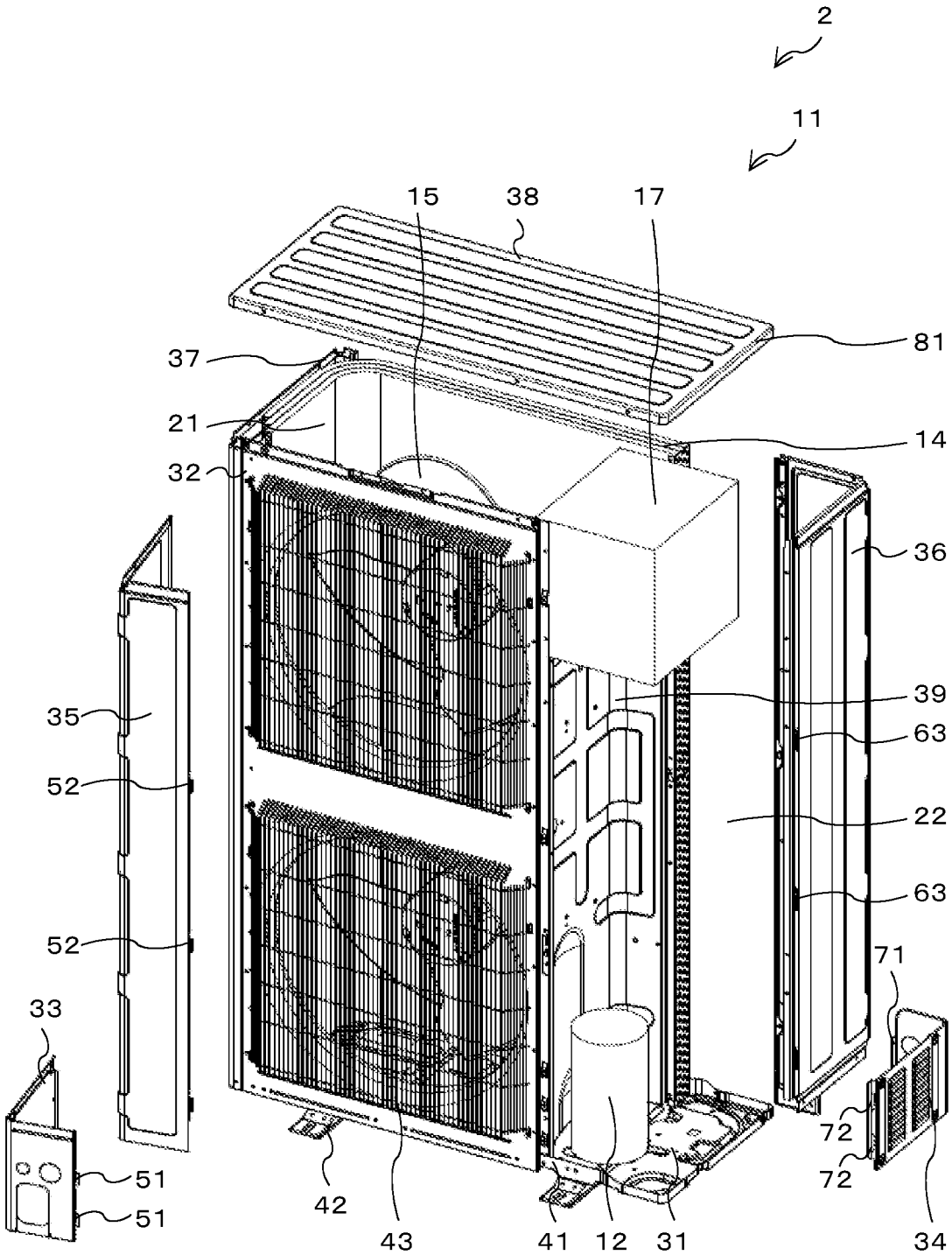
FIG. 3 is a front perspective view showing the outdoor unit 2 according to Embodiment 1.
Figure 4:
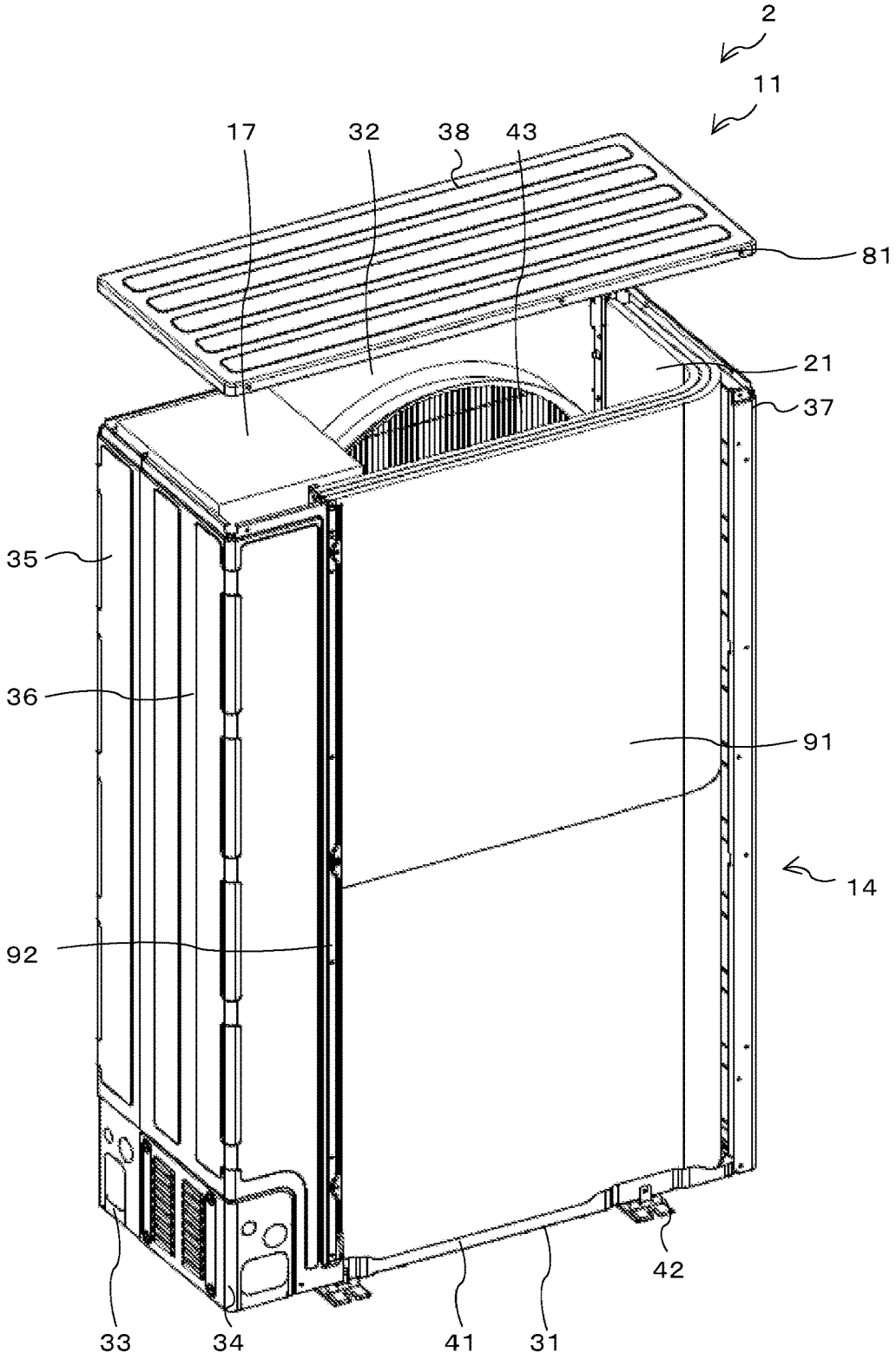
FIG. 4 is a rear perspective view showing the outdoor unit 2 according to Embodiment 1.

FIG. 2 is a front perspective view showing the outdoor unit 2 according to Embodiment 1. FIG. 3 is a front perspective view showing the outdoor unit 2 according to Embodiment 1. FIG. 4 is a rear perspective view showing the outdoor unit 2 according to Embodiment 1. As shown in FIG. 2 to FIG. 4, the housing 11 forms the outer shell of the outdoor unit 2, and includes a base plate 31, a fan panel 32, a front lower panel 33, a rear lower panel 34, a front panel 35, a rear panel 36, a fan chamber side panel 37, and a top panel 38. A partition plate 39 is provided in the housing 11.

Each of the base plate 31, the fan panel 32, the front lower panel 33, the rear lower panel 34, the front panel 35, the rear panel 36, the fan chamber side panel 37 and the top panel 38 is a plate-like part obtained by molding, with dies, a steel sheet to which rust prevention treatment is applied, such as a PCM steel sheet. Rust prevention treatment is not necessarily applied to the end surfaces of each part forming the housing 11. The respective parts forming the housing 11 are fixed by screws or the like to assemble the housing 11. As will be described later, some parts forming the housing 11 have claw-like parts. The claw-like part is used for temporary fixing when the housing 11 is assembled. In Embodiment 1, temporary fixing indicates simply fixing the respective parts without using a tool or the like. With such an operation, the respective parts can be positioned and hence, the housing 11 can be easily assembled. Rust prevention treatment is not necessarily applied to each claw-like part. The partition plate 39 is a plate-like part that divides the inside of the housing 11 into a fan chamber 21 and a machine chamber 22. The fan chamber 21 is a space where the outdoor fans 15 and the like are housed. The machine chamber 22 is a space where the electric component box 17 and the like are housed.

(Compressor 12)

The compressor 12 suctions refrigerant at low temperature and low pressure, compresses the suctioned refrigerant to form refrigerant at high temperature and high pressure, and then discharges the refrigerant. As shown in FIG. 3, the compressor 12 is accommodated in the machine chamber 22. The compressor 12 may be an inverter compressor, for example, that is driven by a motor (not shown in the drawing), where frequency is controlled by an inverter (not shown in the drawing).

(Flow Passage Switching Device 13)

The flow passage switching device 13 switches a flow direction of refrigerant, and may be a four-way valve, for example. During a cooling operation, the flow passage switching device 13 connects the discharge side of the compressor 12 with the outdoor heat exchanger 14, and connects the suction side of the compressor 12 with the indoor heat exchanger 18. During a heating operation, the flow passage switching device 13 connects the discharge side of the compressor 12 with the indoor heat exchanger 18, and connects the suction side of the compressor 12 with the outdoor heat exchanger 14. The flow passage switching device 13 is not limited to the four-way valve. The flow passage switching device 13 may be formed such that a plurality of two-way valves or three-way valves, for example, are combined with each other to provide a function similar to the function of the four-way valve.

(Outdoor Heat Exchanger 14)

The outdoor heat exchanger 14 performs heat exchange between outdoor air and refrigerant flowing through the outdoor heat exchanger 14. The outdoor heat exchanger 14 may be a fin-and-tube heat exchanger, for example. The outdoor heat exchanger 14 serves as a condenser during the cooling operation, and serves as an evaporator during the heating operation. The outdoor heat exchanger 14 is provided to extend at the side portion and the rear portion of the housing 11 from the lower portion toward the upper portion of the housing 11. Further, the outdoor heat exchanger 14 expands over the side surface at positions on the side of the fan chamber 21 and the rear surface of the housing 11. The outdoor heat exchanger 14 has an L shape as viewed in a top plan view. The outdoor heat exchanger 14 includes a heat exchanger body 91 and a heat exchanger side plate 92 (see FIG. 5), The heat exchanger body 91 has an L shape as viewed in a top plan view. The heat exchanger side plate 92 covers the side portion of the heat exchanger body 91. The heat exchanger body 91 includes flat tubes (not shown in the drawing) and fins (not shown in the drawing). Refrigerant flows through the flat tubes. The flat tubes are inserted through the fins to promote heat exchange between outdoor air and refrigerant flowing through the flat tubes.

Figure 5:
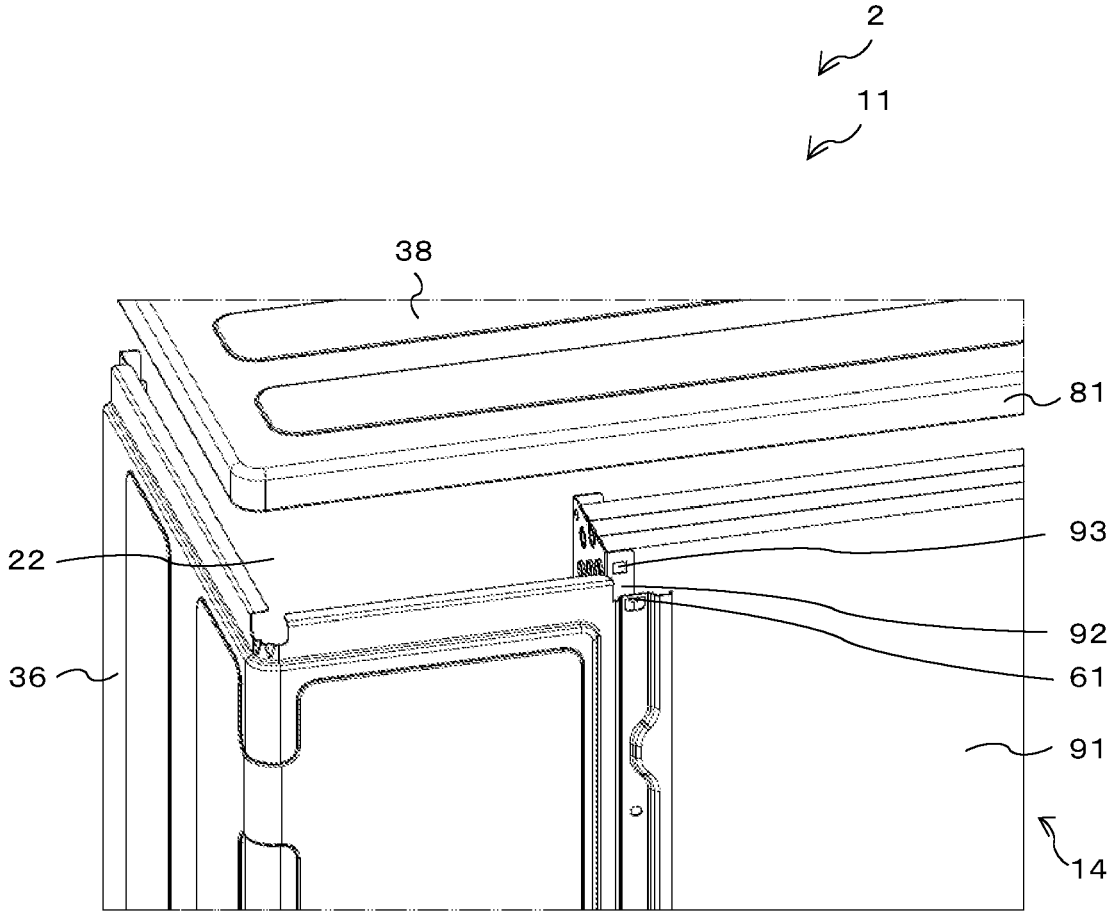
FIG. 5 is a perspective view showing a heat exchanger side plate 92 according to Embodiment 1.
Figure 6:
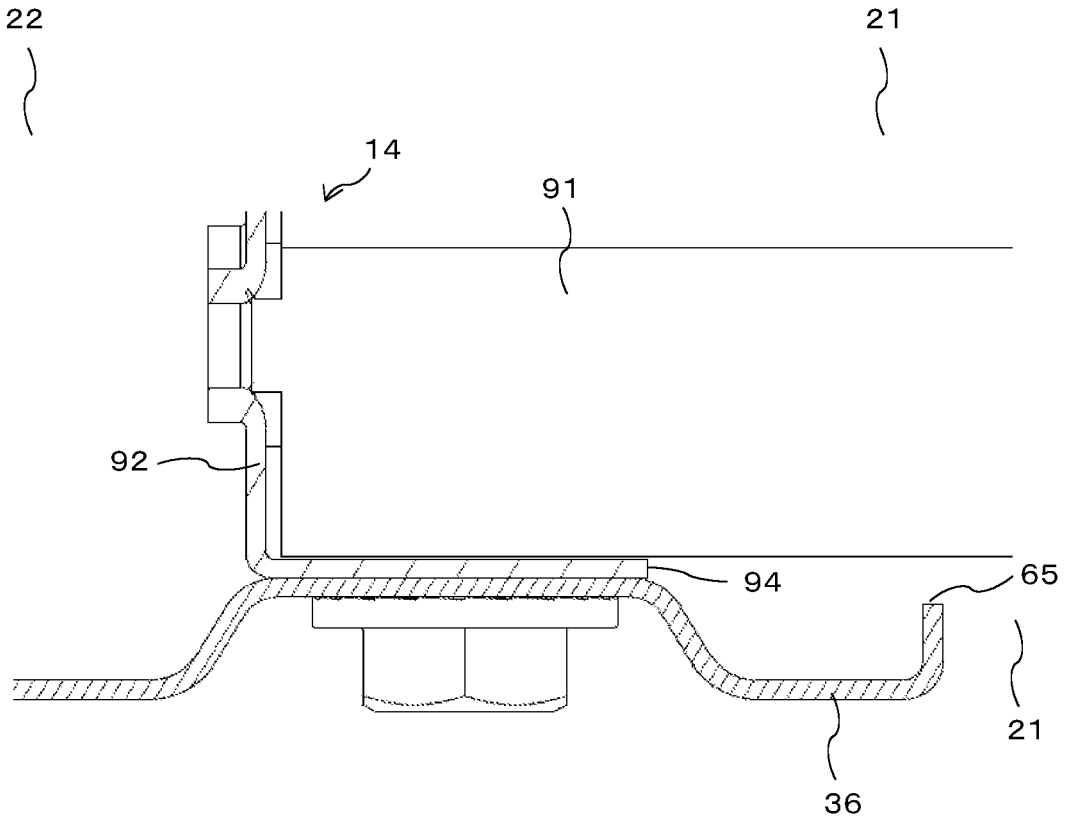
FIG. 6 is a configuration diagram showing the heat exchanger side plate 92 according to Embodiment 1.

FIG. 5 is a perspective view showing the heat exchanger side plate 92 according to Embodiment 1. FIG. 6 is a configuration diagram showing the heat exchanger side plate 92 according to Embodiment 1. FIG. 6 shows the cross section of the outdoor unit 2 taken along the horizontal direction passing through the heat exchanger side plate 92. As shown in FIG. 5, the heat exchanger side plate 92 covers the side portion of the heat exchanger body 91, thus forming the side portion of the outdoor heat exchanger 14 at a position on the side of the machine chamber 22. The heat exchanger side plate 92 has a U shape that is bent with substantially right angles as viewed in a top plan view. The heat exchanger side plate 92 has a side plate locking hole 93 at a position on the side of the rear surface. The side plate locking hole 93 is an opening port formed at the upper portion of the heat exchanger side plate 92. An upper rear-surface locking claw 61 of the rear panel 36, which will be described later, is inserted into the side plate locking hole 93. Another part having an opening port corresponding to the side plate locking hole 93 may be provided in the housing 11.

As shown in FIG. 6, the heat exchanger side plate 92 has a side plate end surface 94. The side plate end surface 94 is an end surface that is provided on the side end portion of the heat exchanger side plate 92 at a position adjacent to the rear surface, and that faces in the lateral direction toward the fan chamber 21. The entire side plate end surface 94 is covered by the rear panel 36. Therefore, even when the housing 11 is exposed to rain water, the rain water impinges on the rear panel 36 and hence, moisture flowing along the rear panel 36 is prevented from easily adhering to the side plate end surface 94.

(Outdoor Fan 15)

The outdoor unit 2 includes two outdoor fans 15. Each outdoor fan 15 is a device that is connected to a motor (not shown in the drawing) and rotates due to the driving of the motor to send outdoor air to the outdoor heat exchanger 14. As shown in FIG. 3, the respective outdoor fans 15 are accommodated in the fan chamber 21 in a state of being arranged in the vertical direction. Note that one or three or more outdoor fans 15 may be used.

(Expansion Unit 16)

The expansion unit 16 causes refrigerant to expand, thus reducing the pressure of the refrigerant. The expansion unit 16 may be an electronic expansion valve, for example.

(Electric Component Box 17)

A control unit (not shown in the drawing), a power supply (not shown in the drawing), and the like are accommodated in the electric component box 17. The control unit controls the actions of respective devices accommodated in the outdoor unit 2. The power supply supplies power to the respective devices accommodated in the outdoor unit 2. As shown in FIG. 3, the electric component box 17 is accommodated in the machine chamber 22.

(Indoor Heat Exchanger 18)

The indoor heat exchanger 18 performs heat exchange between indoor air and refrigerant. The indoor heat exchanger 18 serves as an evaporator during the cooling operation, and serves as a condenser during the heating operation.

(Indoor Fan 19)

The indoor fan 19 is a device that sends indoor air to the indoor heat exchanger 18.

Next, the action of the air-conditioning apparatus 1 will be described. First, the cooling operation will be described. Refrigerant is suctioned into and compressed by the compressor 12, and is then discharged in a gaseous state at high temperature and high pressure. The discharged refrigerant passes through the flow passage switching device 13, and flows into the outdoor heat exchanger 14. The refrigerant that flows into the outdoor heat exchanger 14 is caused to exchange heat with outdoor air, being a heat medium, thus being condensed. The condensed refrigerant flows into the expansion unit 16 of each indoor unit 3, and is caused to expand by the expansion unit 16, thus reducing the pressure of the refrigerant. The refrigerant reduced in pressure flows into the indoor heat exchanger 18. The refrigerant that flows into the indoor heat exchanger 18 is caused to exchange heat with indoor air, thus being evaporated. At this point of operation, the indoor air is cooled, so that the room is cooled. Thereafter, the evaporated refrigerant passes through the flow passage switching device 13, and is then suctioned into the compressor 12.

Next, the heating operation will be described. Refrigerant is suctioned into and compressed by the compressor 12, and is then discharged in a gaseous state at high temperature and high pressure. The discharged refrigerant passes through the flow passage switching device 13, and flows into the indoor heat exchanger 18 of each indoor unit 3. The refrigerant that flows into the indoor heat exchanger 18 is caused to exchange heat with indoor air, thus being condensed. At this point of operation, the indoor air is heated, so that the room is heated. The condensed refrigerant flows into the expansion unit 16, and is caused to expand by the expansion unit 16, thus reducing the pressure of the refrigerant. The refrigerant reduced in pressure flows into the outdoor heat exchanger 14. The refrigerant that flows into the outdoor heat exchanger 14 is caused to exchange heat with outdoor air, being a heat medium, thus being evaporated. Thereafter, the evaporated refrigerant passes through the flow passage switching device 13, and is then suctioned into the compressor 12.

(Base Plate 31)

The base plate 31 is a plate-like part forming the bottom surface of the housing 11. The base plate 31 includes a base edge 41 and leg portions 42. The base edge 41 is the edge portion of the base plate 31, and extends upward. The leg portions 42 are leg-like parts provided at the lowest portion of the base plate 31 to support the load of the entire outdoor unit 2.

(Fan Panel 32)

As shown in FIG. 2 to FIG. 4, the fan panel 32 is a plate-like part that forms the front surface of the housing 11 at a position on the side of the fan chamber 21. The fan panel 32 has opening ports at portions that face the outdoor fans 15, and air sent by the outdoor fans 15 passes through the opening ports. The fan panel 32 is connected to the base plate 31. The fan panel 32 includes fan covers 43. Each fan cover 43 is a part that is provided to cover the opening port for the outdoor fan 15, and that is formed into a lattice shape.

(Front Lower Panel 33)

As shown in FIG. 2 to FIG. 4, the front lower panel 33 is a plate-like part that forms the side lower portion of the front surface of the housing 11 at a position on the side of the machine chamber 22 and that forms, at a position adjacent to the front surface, the lower portion of the side surface at a position on the side of the machine chamber 22. The front lower panel 33 has an L shape as viewed in a top plan view. The lower portion of the front lower panel 33 is connected with the base edge 41 of the base plate 31. The front lower panel 33 includes two front lower locking claws 51. The front lower locking claws 51 are claw-like parts formed at the side portion of the side surface of the front lower panel 33, the side surface being at a position on the side of the machine chamber 22. When the front lower locking claws 51 are inserted into the rear lower locking holes 72 of the rear lower panel 34, which will be described later, thus being locked to the rear lower panel 34, the front lower panel 33 is temporarily fixed to the rear lower panel 34.

(Rear Lower Panel 34)

As shown in FIG. 2 to FIG. 4, the rear lower panel 34 is a plate-like part that forms the side lower portion of the rear surface of the housing 11 at a position on the side of the machine chamber 22 and that forms, at a position adjacent to the rear surface, the lower portion of the side surface at a position on the side of the machine chamber 22. The rear lower panel 34 has an L shape as viewed in a top plan view. The lower portion of the rear lower panel 34 is connected with the base edge 41.

Figure 7:
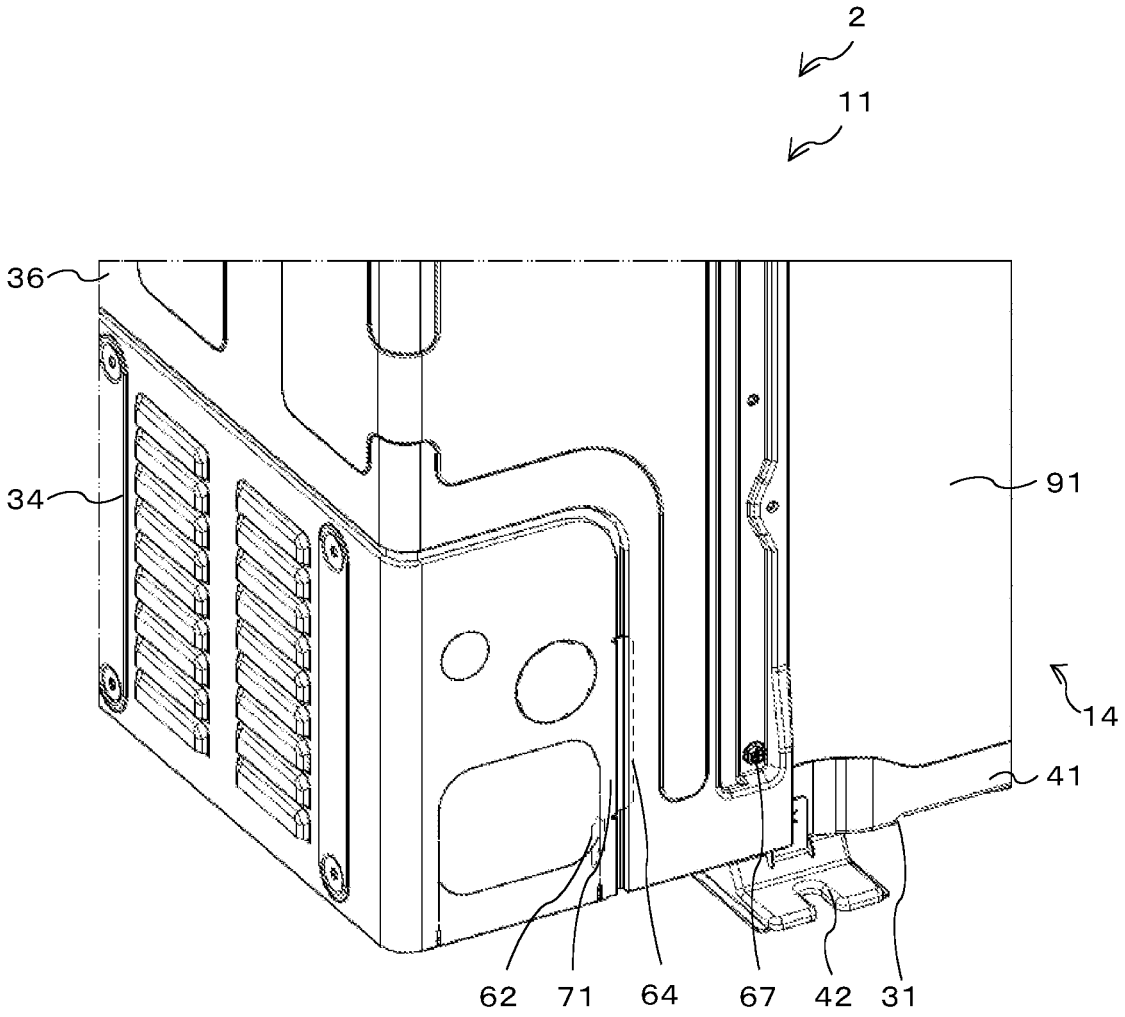
FIG. 7 is a perspective view showing a rear lower panel 34 according to Embodiment 1.

FIG. 7 is a perspective view showing the rear lower panel 34 according to Embodiment 1. The rear lower panel 34 includes a rear lower locking claw 71. The rear lower locking claw 71 is a claw-like part formed at the side portion of the rear lower panel 34 on the rear surface. When the rear lower locking claw 71 is inserted into a rearward rear-surface locking hole 64 of the rear panel 36, which will be described later; thus being locked to the rear panel 36, the rear lower panel 34 is temporarily fixed to the rear panel 36. As shown in FIG. 7, the end portion of the rear lower locking claw 71 is in the machine chamber 22. That is, the end portion of the rear lower locking claw 71 is covered by the rear panel 36, thus being prevented from being seen from the outside. Therefore, even when rust is formed at the end portion of the rear lower locking claw 71, design performance of the rear lower panel 34 is hardly impaired.

As shown in FIG. 3, the rear lower panel 34 has two rear lower locking holes 72. The rear lower locking holes 72 are opening ports formed in the side portion of the side surface of the rear lower panel 34, the side surface being at a position on the side of the machine chamber 22. The front lower locking claws 51 of the front lower panel 33 are inserted into the rear lower locking holes 72. The front lower locking claws 51 are respectively inserted into the rear lower locking holes 72.

(Front Panel 35)

As shown in FIG. 2 to FIG. 4, the front panel 35 is a plate-like part that forms the side portion of the front surface of the housing 11 at a position on the side of the machine chamber 22 and that forms, at a position adjacent to the front surface, the portion of the side surface at a position on the side of the machine chamber 22. The front panel 35 has an L shape as viewed in a top plan view. The front panel 35 includes two front locking claws 52. The front locking claws 52 are claw-like parts formed at the side portion of the side surface of the front panel 35, the side surface being at a position on the side of the machine chamber 22. When the front locking claws 52 are inserted into forward rear-surface locking holes 63 of the rear panel 36, which will be described later, thus being locked to the rear panel 36, the front panel 35 is temporarily fixed to the rear panel 36.

Figure 8:
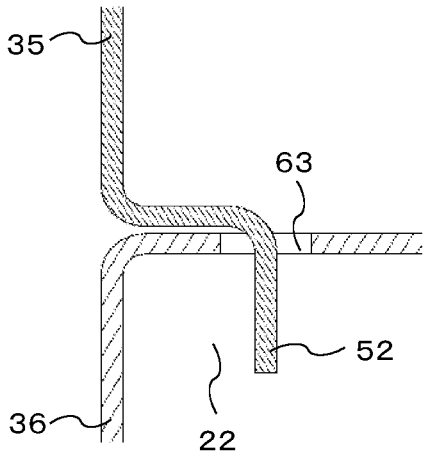
FIG. 8 is a configuration diagram showing a front locking claw 52 according to Embodiment 1.

FIG. 8 is a configuration diagram showing the front locking claw 52 according to Embodiment 1. FIG. 8 shows the cross section of the housing 11 taken along the horizontal direction passing through the front locking claw 52. As shown in FIG. 8, the end portion of the front locking claw 52 is in the machine chamber 22, That is, the end portion of the front locking claw 52 is covered by the rear panel 36 thus being prevented from being seen from the outside. Therefore, even when rust is formed at the end portion of the front locking claw 52, design performance of the front panel 35 is hardly impaired.

(Rear Panel 36)

As shown in FIG. 2 to FIG. 4, the rear panel 36 is a plate-like part that forms the side portion of the rear surface of the housing 11 at a position on the side of the machine chamber 22 and that forms, at a position adjacent to the rear surface, the portion of the side surface at a position on the side of the machine chamber 22. The rear panel 36 has an L shape as viewed in a top plan view. The lower portion of the rear surface of the rear panel 36 is connected to the base edge 41.

Figure 9:
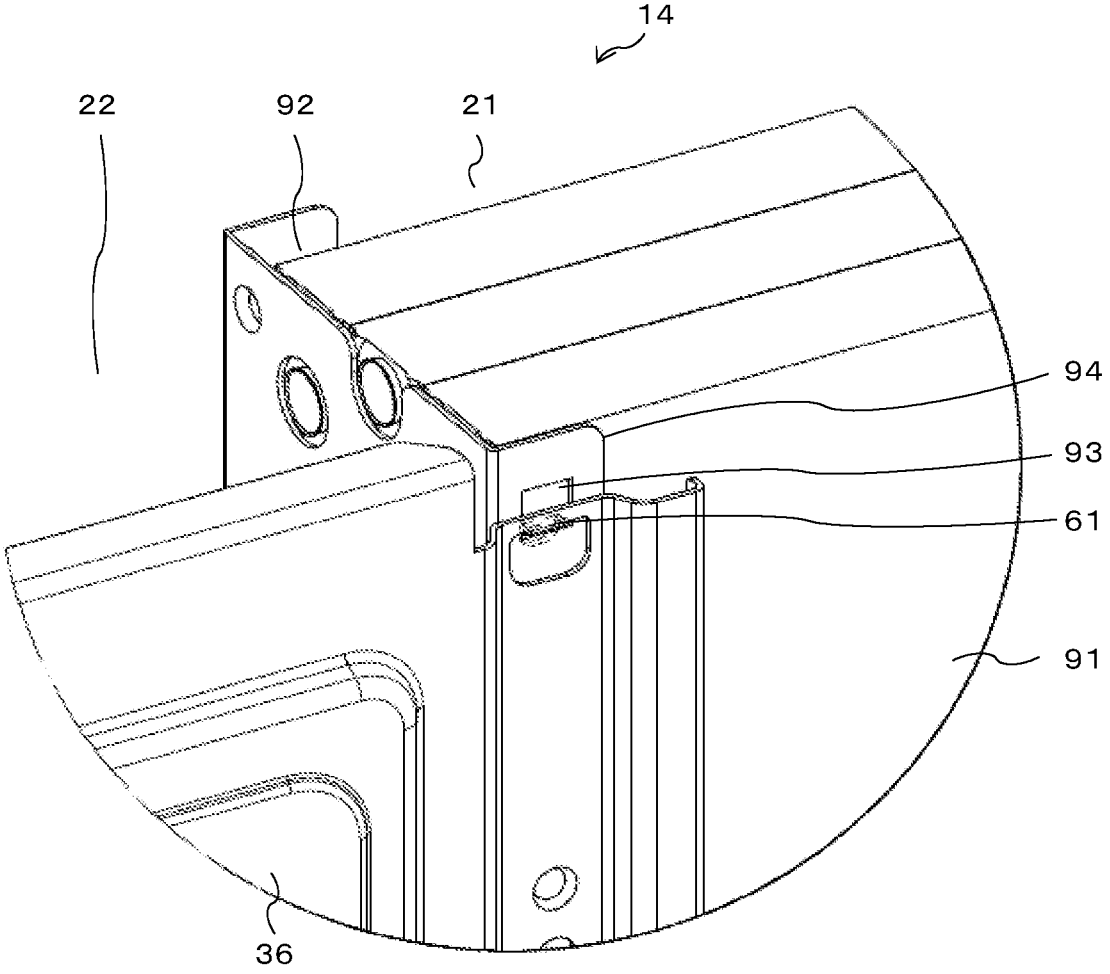
FIG. 9 is a perspective view showing a rear panel 36 according to Embodiment 1.

FIG. 9 is a perspective view showing the rear panel 36 according to Embodiment 1. As shown in FIG. 9, the rear panel 36 includes the upper rear-surface locking claw 61. The upper rear-surface locking claw 61 is a claw-like part formed at the upper portion of the rear surface of the rear panel 36. When the upper rear-surface locking claw 61 is inserted into the side plate locking hole 93, thus being locked to the heat exchanger side plate 92, the rear panel 36 is temporarily fixed to the heat exchanger side plate 92. Further, when a rear-surface upper screw 66 (see FIG. 11) is fastened at the upper portion of the rear surface, the rear panel 36 is fixed to the heat exchanger side plate 92.

Figure 10:
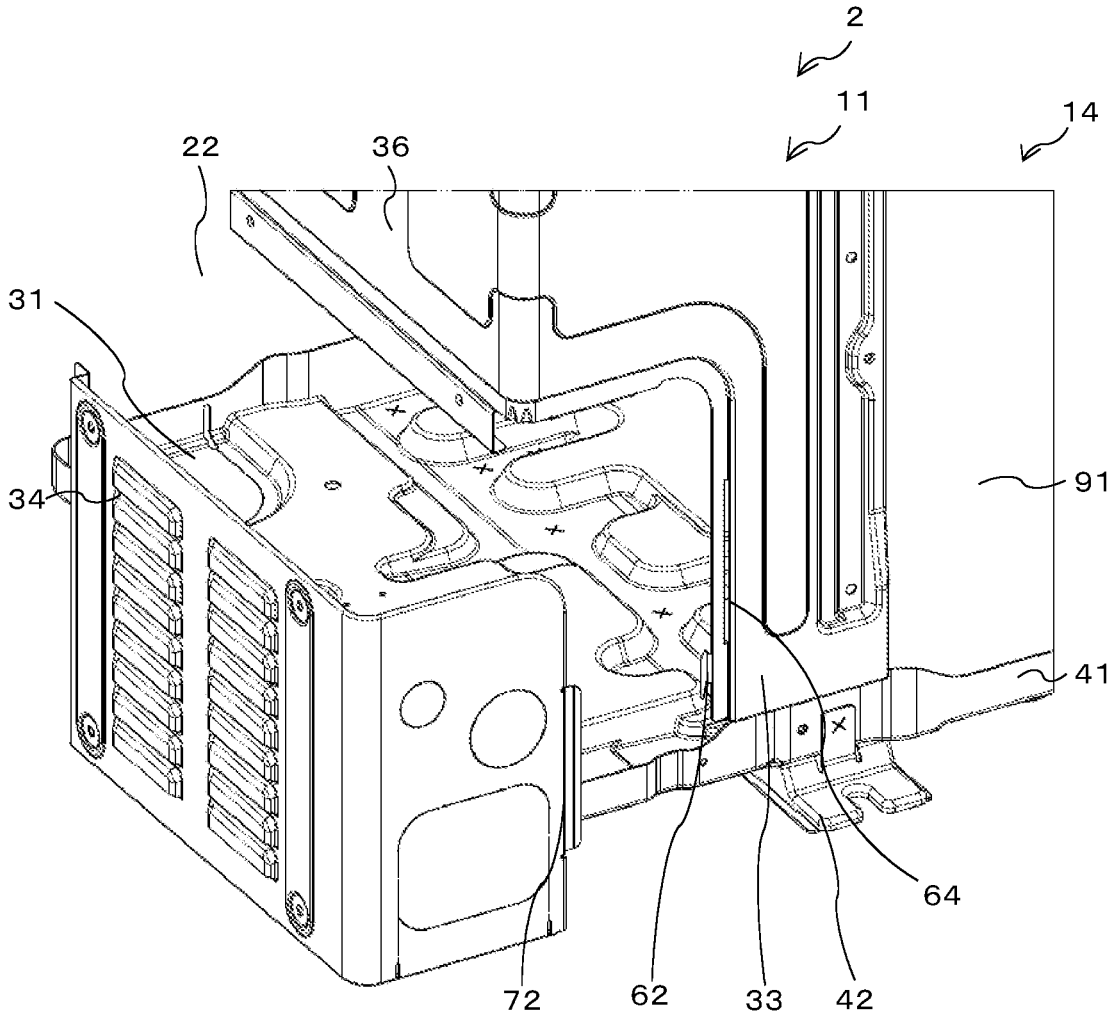
FIG. 10 is a perspective view showing the rear panel 36 according to Embodiment 1.

FIG. 10 is a perspective view showing the rear panel 36 according to Embodiment 1. As shown in FIG. 10, the rear panel 36 includes a lower rear-surface locking claw 62. The lower rear-surface locking claw 62 is a claw-like part formed on the rear surface of the rear panel 36 at the side lower portion at a portion on the side of the machine chamber 22. When the lower rear-surface locking claw 62 is locked to the end surface of the rear lower panel 34, the lower rear-surface locking claw 62 is fixed to the rear lower panel 34. That is, the end portion of the lower rear-surface locking claw 62 is covered by the rear lower panel 34, thus being prevented from being seen from the outside. Therefore, even when rust is formed at the end portion of the lower rear-surface locking claw 62, design performance of the rear panel 36 is hardly impaired. Further, when a rear-surface lower screw 67 (see FIG. 7) is fastened at the lower portion of the rear surface, the rear panel 36 is fixed to the heat exchanger side plate 92.

As shown in FIG. 3, the rear panel 36 has two forward rear-surface locking holes 63. The forward rear-surface locking holes 63 are opening ports formed in the side portion of the side surface of the rear panel 36, the side surface being at a position on the side of the machine chamber 22. The front locking claws 52 of the front panel 35 are inserted into the forward rear-surface locking holes 63. The front locking claws 52 are respectively inserted into the forward rear-surface locking holes 63.

As shown in FIG. 10, the rear panel 36 has the rearward rear-surface locking hole 64. The rearward rear-surface locking hole 64 is an opening port formed in the rear surface of the rear panel 36 at the side lower portion at a position on the side of the machine chamber 22. The rear lower locking claw 71 of the rear lower panel 34 is inserted into the rearward rear-surface locking hole 64.

As shown in FIG. 6 and FIG. 9, the rear panel 36 has a rear panel end surface 65. The rear panel end surface 65 is the end surface of the side edge portion of the rear panel 36, the side edge portion being at a position on the side of the fan chamber 21. The rear panel end surface 65 faces toward the inside of the housing 11, Therefore, the rear panel end surface 65 is prevented from being easily seen when viewed from the rear. Accordingly, even when rust is formed on the rear panel end surface 65, design performance of the rear panel 36 is hardly impaired.

(Fan Chamber Side Panel 37)

As shown in FIG. 3 and FIG. 4, the fan chamber side panel 37 is a plate-like part that forms the side surface of the housing 11 at a position on the side of the fan chamber 21. The fan chamber side panel 37 has a plurality of opening ports (not shown in the drawing).

(Top Panel 38)

Figure 11:
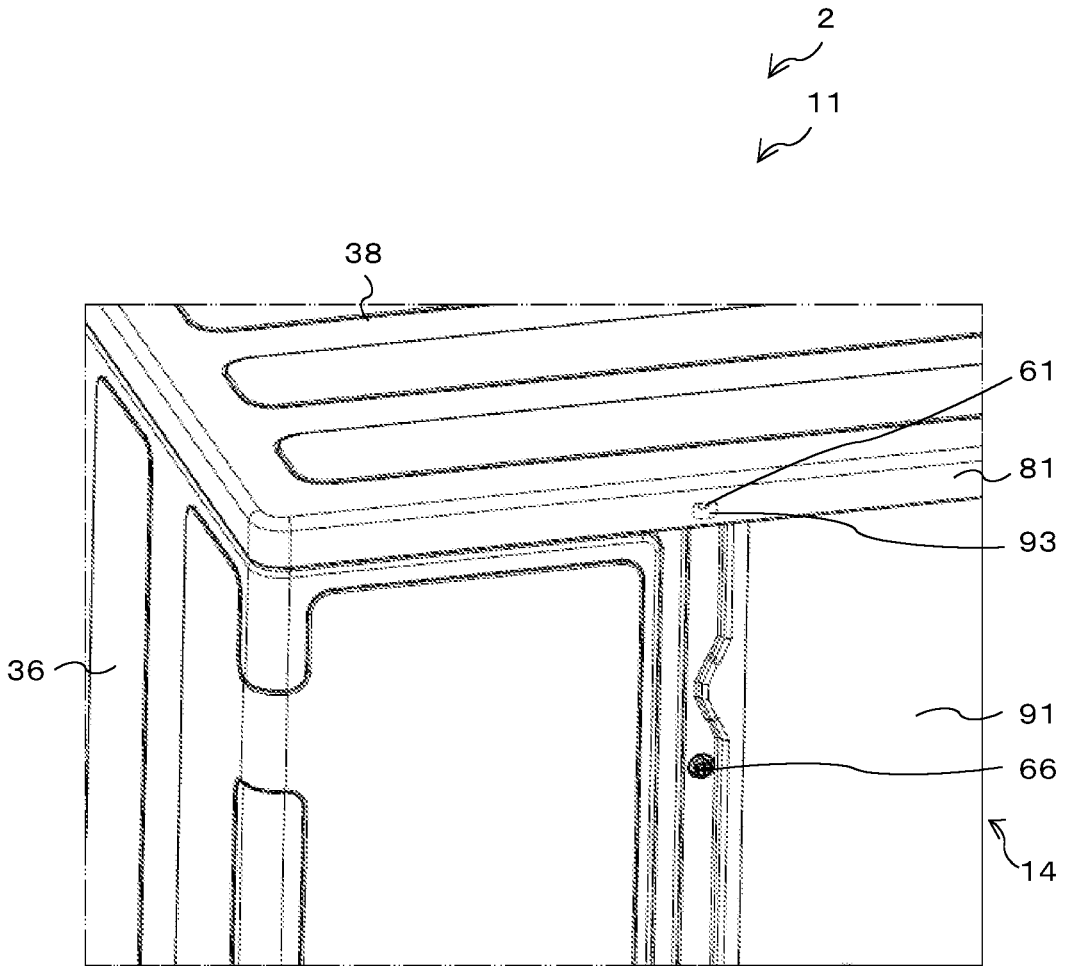
FIG. 11 is a perspective view showing a top panel 38 according to Embodiment 1.

FIG. 11 is a perspective view showing the top panel 38 according to Embodiment 1. The top panel 38 is a plate-like part provided on the upper side of the rear panel 36 and forming the top surface of the housing 11. The top panel 38 includes a top surface edge 81. The top surface edge 81 is the edge portion of the top panel 38, and extends downward. The top surface edge 81 covers the upper rear-surface locking claw 61 and the side plate locking hole 93. Therefore, rain water or the like is prevented from easily adhering to the upper rear-surface locking claw 61 and the side plate locking hole 93.

In Embodiment 1, the top panel 38 covers the side plate locking hole 93 and the upper rear-surface locking claw 61. Therefore, even when the outdoor unit 2 of the air-conditioning apparatus 1 is exposed to rain water, the rain water impinges on the top panel 38 and hence, moisture is prevented from easily adhering to the side plate locking hole 93 and the upper rear-surface locking claw 61. Accordingly, in the outdoor unit 2 of the air-conditioning apparatus 1, it is possible to suppress the formation of rust on the side plate locking hole 93 and the upper rear-surface locking claw 61.

Further, the formation of rust on the side plate locking hole 93 and the upper rear-surface locking claw 61 is suppressed and hence, a pipe (not shown in the drawing) in the housing 11 is not easily corroded due to rust advancing from the side plate locking hole 93 and the upper rear-surface locking claw 61.

In Embodiment 1, the entire side plate end surface 94 is covered by the rear panel 36. Therefore, even when the housing 11 is exposed to rain water, moisture flowing along the rear panel 36 is prevented from easily adhering to the side plate end surface 94. Accordingly, it is possible to suppress the formation of rust on the side plate end surface 94.

In Embodiment 1, the rear panel end surface 65 faces toward the inside of the housing 11. Therefore, the rear panel end surface 65 is prevented from being easily seen when viewed from the rear. Accordingly, even when rust is formed on the rear panel end surface 65, design performance of the rear panel 36 is hardly impaired.

In Embodiment 1, the housing 11 is formed using a steel sheet to which rust prevention treatment is applied. Therefore, by suppressing adhesion of rain water to the end surfaces of the respective parts forming the housing 11 and to the claw-like parts used for temporary fixing, for example, it is also possible to suppress the formation of rust across the entire housing 11. Further, the end surfaces of the respective parts forming the housing 11 and the claw-like parts used for temporary fixing are covered by another part and hence, even when rust is formed, the rust is prevented from being easily seen by a user. Accordingly, the outdoor unit 2 of the air-conditioning apparatus 1 can maintain design performance.

REFERENCE SIGNS LIST

1: air-conditioning apparatus, 2: outdoor unit, 3: indoor unit, 4: refrigerant pipe, 11: housing, 12: compressor, 13: flow passage switching device, 14: outdoor heat exchanger, 15: outdoor fan, 16: expansion unit, 17: electric component box, 18: indoor heat exchanger, 19: indoor fan, 21: fan chamber, 22: machine chamber, 31: base plate, 32: fan panel, 33: front lower panel, 34: rear lower panel, 35: front panel, 36: rear panel, 37: fan chamber side panel, 38: top panel, 39: partition plate, 41: base edge, 42: leg portion, 43: fan cover, 51: front lower locking claw, 52: front locking claw, 61: upper rear-surface locking claw, 62: lower rear-surface locking claw, 63: forward rear-surface locking hole, 64: rearward rear-surface locking hole, 65: rear panel end surface, 66: rear-surface upper screw, 67: rear-surface lower screw, 71: rear lower locking claw, 72: rear lower locking hole, 81: top surface edge, 91: heat exchanger body, 92: heat exchanger side plate, 93: side plate locking hole, 94: side plate end surface

The invention claimed is:

1. An outdoor unit of an air-conditioning apparatus, the outdoor unit comprising:

a housing configured to form an outer shell and having a fan chamber and a machine chamber inside;

a heat exchanger provided to extend at a rear portion of the housing from a lower portion toward an upper portion of the housing, an outdoor fan housed in the fan chamber and sending air to the heat exchanger, and a partition plate separating the fan chamber and the machine chamber, wherein the heat exchanger includes a heat exchanger side plate provided on a side portion of the heat exchanger located at a machine chamber side of the heat exchanger and having a side plate locking hole at an upper portion, and the housing includes a rear panel forming a rear surface of the housing and including an upper rear-surface locking claw at an upper portion, the upper rear-surface locking claw being inserted into the side plate locking hole, a top panel provided on an upper side of the rear panel and forming a top surface of the housing, the top panel covering the side plate locking hole and the upper rear-surface locking claw, and a fan chamber side panel configured to form a side surface of the housing at a position on the side of the fan chamber, wherein an end portion of the rear panel at a position closest to the fan chamber side panel is located closer to the fan chamber side panel than a side end portion of the heat exchanger side plate, the rear panel covers an end surface of the side end portion of the heat exchanger side plate, the housing further comprises a front panel forming a side portion of a front surface of the housing, the front panel comprises a front locking claw positioned at a side portion of the front panel, the rear panel comprises a forward rear-surface locking hole formed on a side portion of the rear panel, and the front locking claw is inserted into the forward rear-surface locking hole.

* * * * *